United States Patent [19]

Hansen et al.

[11] Patent Number: 4,683,881

[45] Date of Patent: Aug. 4, 1987

[54] BREATHING REGULATOR MOUTHPIECE

[75] Inventors: Harmon R. Hansen, Stanton; Thomas A. Lingenfelter, Garden Grove, both of Calif.

[73] Assignee: U.S.D. Corp., Santa Ana, Calif.

[21] Appl. No.: 792,809

[22] Filed: Oct. 30, 1985

[51] Int. Cl.[4] ..... A62B 7/04

[52] U.S. Cl. ..... 128/204.26; 128/204.27; 137/494

[58] Field of Search ..... 128/204.26, 209.27; 137/494

[56] References Cited

U.S. PATENT DOCUMENTS

| | | | |
|---|---|---|---|
| 3,285,261 | 11/1966 | Chaney | 128/204.26 |
| 4,337,766 | 7/1982 | Feathers | 128/204.26 |
| 4,446,859 | 5/1984 | Pedersen | 137/494 |
| 4,467,797 | 8/1984 | Franke | 128/204.26 |
| 4,572,176 | 2/1986 | Walther | 128/204.26 |

*Primary Examiner*—Albert J. Makay
*Assistant Examiner*—David W. Westphal
*Attorney, Agent, or Firm*—George F. Bethel; Patience K. Bethel

[57] ABSTRACT

The disclosure sets forth a breathing gas second stage regulator having a tilt valve for introducing breathing gas into a breathing box through means of a diaphragm flexing into the interior thereof. Lever means connect the tilt valve to the diaphragm so that as said diaphragm flexes internally it causes said lever to move and actuate the valve. A mouthpiece is connected to the interior of the chamber of the regulator for providing an inlet and outlet to a breather. The chamber at the mouthpiece interface is configured with a curved surface to enhance laminar flow and reduce turbulent flow into the chamber from the mouthpiece upon a user's exhalation. The curved surface limits backflow and stall, as well as limiting the separation of exhalation exhaust until proximate an exhaust valve. An exhaust valve opening within the chamber walls has an exhaust valve therein so that exhaust upon exhalation from a user can pass through said exhaust valve outwardly. The exhaust valve incorporates aerodynamically designed ribs which support an elastomeric flapper. An exhaust valve tee is placed in flow connected relationship to the exhaust valve. The tee has a conical protuberance near the center of the exhaust valve and extends outwardly to the exhaust tee outlet ports to deflect air and water from the exhaust tee during the exhalation cycle to provide less resistance.

20 Claims, 7 Drawing Figures

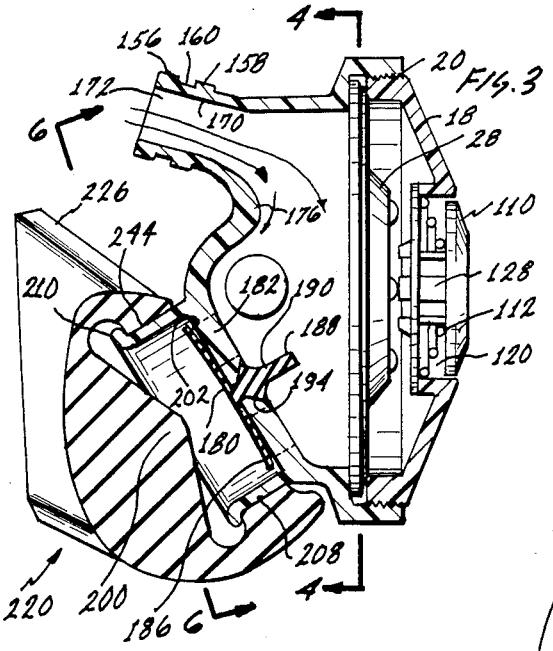
FIG. 3
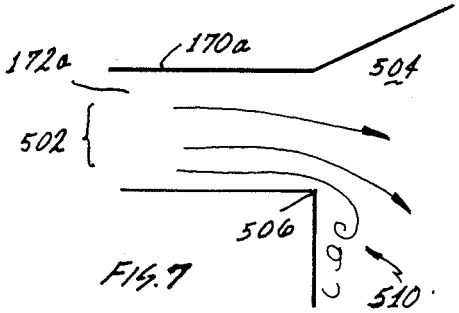
FIG. 7
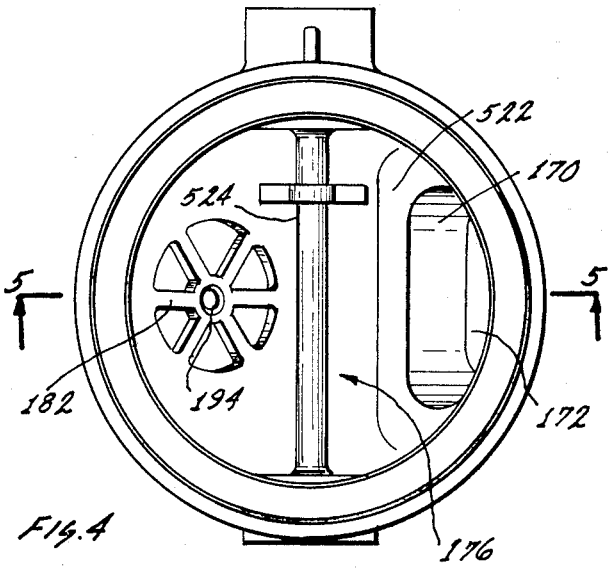
FIG. 4
FIG. 5
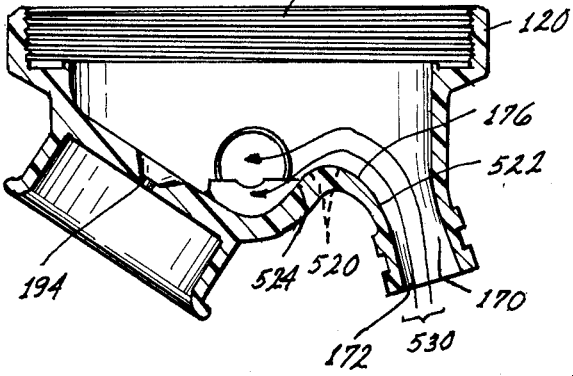
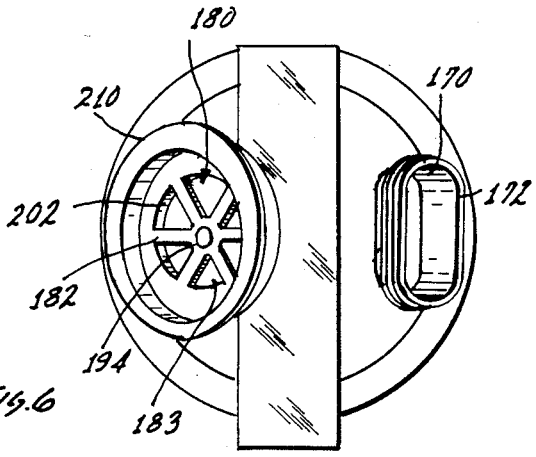
FIG. 6

BREATHING REGULATOR MOUTHPIECE

FIELD OF THE INVENTION

The field of this invention lies within the breathing gas art. In particular, it lies within the breathing gas art as it pertains to the regulation of breathing gas from a source of gas under pressure to a user of such breathing gas. The user of such breathing gas can be a person using self contained underwater breathing apparatus or self contained breathing apparatus for industrial or safety reasons, such as in the case of industrial or firemen's breathing equipment. More particularly, the invention resides within the field of second stage breathing gas regulation as is known in the second stage regulator art.

THE PRIOR ART

The prior art with respect to this invention resides in some measure within the printed publications and advertisements, as well as patents of the assignee of this invention, which generally sets forth various configurations for second stage breathing gas regulators. Also, the Applicants' assignee's competitors, such as Dacor, Under Sea Industries, and others in the diving industry have evolved second stage breathing gas regulators of various configurations. However, in no instance is it felt that the general tilt valve regulators as shown in the prior art have the features that are sought to be patented in this particular application.

The foregoing second stage regulators have a tilt valve assembly which introduces a source of breathing gas under pressure. Generally, the source of breathing gas is from a first stage regulator that has been connected to a tank of breathing gas. The tank of breathing gas causes gas to flow through the first stage regulator on a regulated basis from a substantially higher pressure within the tank to an intermediate pressure. This intermediate pressure is then regulated by the breathing gas regulator of this invention on a demand basis.

The demand basis is controlled by means of a chamber provided within certain walls. The chamber within the walls has an opening which received a diaphragm. The diaphragm upon inhalation flexes inwardly and is in contact with a lever. The lever is in connected relationship to a valve which allows for the introduction of the breathing gas from the intermediate pressure zone into the chamber. Thus, upon inhalation by a user, the tilt valve allows the flow of gas thereinto for breathing purposes through the regulated actuation of the diaphragm flexing inwardly upon inhalation.

Exhaust gas is vented from a user's lungs through a mouthpiece into the chamber and outwardly through an exhaust valve. Generally, the exhaust valve is in the form of an elastomeric member which seats over a plurality of ribs that support the elastomeric member and also is seated against a surrounding edge region adjacent the outer portions of the ribs. As the breathing gas is exhausted outwardly, it passes into a zone where it is vented through an exhaust conduit.

The prior art has included exhaust conduits of various configurations which can be such where they bifurcate the exhaust into two tee outlets. On the other hand, some exhaust has been vented directly outwardly.

The exhaust valves of the prior art use a mushroom shaped exhaust valve generally supported by three or four support ribs and a stem support ring. The stem support ring receives a mushroom shaped flapper valve having a stem extending therethrough which is received in the support ring.

The flapper valve which is a mushroom shaped elastomeric member seats over the ribs and around the surrounding area. It is this action that maintains the flapper valve in its closed position until exhaust pushes it outwardly away from the ribs and the surrounding area of the exhaust opening.

The exhaust gas being vented from a user's lung as previously stated, passes through a mouthpiece. As it passes through the mouthpiece, it passes into a chamber and outwardly through an exhaust valve. When passing into the chamber, the exhaust air generally passes through a tube connecting a mouthpiece to the interior of the chamber. In the alternative, the mouthpiece can be directly connected to the chamber.

The transition from the mouthpiece or the conduit from the mouthpiece to the chamber is generally configured so that it operates as an expansion chamber. An abrupt transition of the exhaust air from a user's lungs through the mouthpiece into the chamber causes laminar flow to become turbulent. It is this turbulent flow that increases the resistance and adds work to the breathing cycle.

It has been found that if the transition is not as abrupt as in the prior art, the laminar flow can remain relatively laminar and thus the air resistance or turbulence is lessened.

In order to accomplish the foregoing, the conduit between the mouthpiece and the chamber or breathing box design is very critical. It has been found that a sharpened edge from the mouthpiece or the conduit into the breathing box creates substantially turbulent flow. Oftentimes, a simple radius is not sufficient. In most cases, it has been found that if the transition can be maintained with an elipse or generally a slow transition to maintain laminar flow, an improved regulator preventing excess work and turbulence, can be created.

This invention specifically provides for overcoming the turbulent flow from a user's mouthpiece into a breathing gas regulator, chamber or box. It is the prevention of this turbulent flow and the substantial maintenance of laminar flow through a smooth transition which enhances the overall operation of this invention. For this reason, it has been a substantial step over the prior art in preventing exhaust pressures and flow characteristics which are represented and equated to extra work by a user of second stage regulators.

SUMMARY OF THE INVENTION

In summation, this invention comprises a second stage breathing gas regulator having an inlet tilt valve that flows gas into a breathing chamber that is interconnected to a mouthpiece for breathing the gas and exhaling it into a chamber with a configuration for exhalation that requires less work through an exhaust valve.

More particularly, the invention comprises a second stage regulator which is in connected relationship to a source of breathing gas that is delivered from a first stage regulator that is in connected relationship to a supply of breathing gas, such as a breathing gas tank. The second stage regulator has a tilt valve assembly. The tilt valve assembly incorporates a tilt valve which is a spring loaded valve member which seats against a valve seat connected to the source of breathing gas.

The second stage regulator has a walled chamber with a breathing box therein, which receives the valve passing thereinto. The breathing box has an enlarged opening therein which has a diaphragm. The diaphragm within the enlarged opening is positioned within the chamber so that as a breather inhales, it flexes inwardly. The inward flexure is transmitted to the tilt valve for providing breathing gas by means of a lever that is in contact with the diaphragm and in connected relationship at the other end to the tilt valve. As the breather breathes inwardly, the lever moves the tilt valve to provide for the delivery of breathing gas.

The breathing gas is delivered to a user through a mouthpiece in connected relationship to the inner chamber of the walled chamber. Upon exhaust from a user outwardly into the chamber, the exhaust is vented through an exhaust valve.

The exhaust air passing from the mouthpiece into the chamber can pass through a direct connection or a conduit or tube. The transition from the mouthpiece into the chamber is by way of a smooth, curved opening. As the exhaust air passes from the mouthpiece, it goes through a transition from the mouthpiece into the housing over a smooth surface, so that the expansion characteristics are compensated for to provide generally laminar flow, instead of turbulent flow. This decreases the resistance and the attendant work in the breathing cycle. This particular feature of this invention is a substantial step over the prior art and enhances the function of the invention to decrease the amount of work through the exhalation cycle. In effect, as the exhaust air passes from the mouthpiece tube into the chamber or box, it passes in a smooth transitional manner with a decreased turbulence, to decrease the resistance and the amount of work required during the breathing cycle.

The exhaust valve is provided over an opening within the walled chamber. The opening within the walled chamber receives an elastomeric valve member which flexes outwardly under positive pressure from the exhaust.

The exhaust valve has a plurality of ribs. The plurality of ribs provide a support ring in the center thereof. The support ring receives an elastomeric stem extending from a round circumferential elastomeric valve member. The elastomeric valve member comprises a circular elastomeric flapper which is received on top of the ribs as well as the surrounding area of the exhaust valve opening.

As will be seen in the following specification, the differences between the prior art and the invention hereof are significant and establish the patentability of the invention hereof.

DESCRIPTION OF THE DRAWINGS

The invention will be more clearly understood by reference to the description below taken in conjunction with the accompanying drawings wherein:

FIG. 3 is a sectional view as taken through a midline view of FIG. 2.

FIG. 4 shows a view in the direction of lines 4—4 of FIG. 3.

FIG. 5 shows a midline sectional view in the direction of lines 5—5 of FIG. 4.

FIG. 6 shows a view looking externally in the direction of lines 6—6 of FIG. 3.

FIG. 7 shows a view of the prior art at the transition point of the mouthpiece entering into the breathing box or chamber.

DESCRIPTION OF THE PREFERRED EMBODIMENTS

Figure 1:
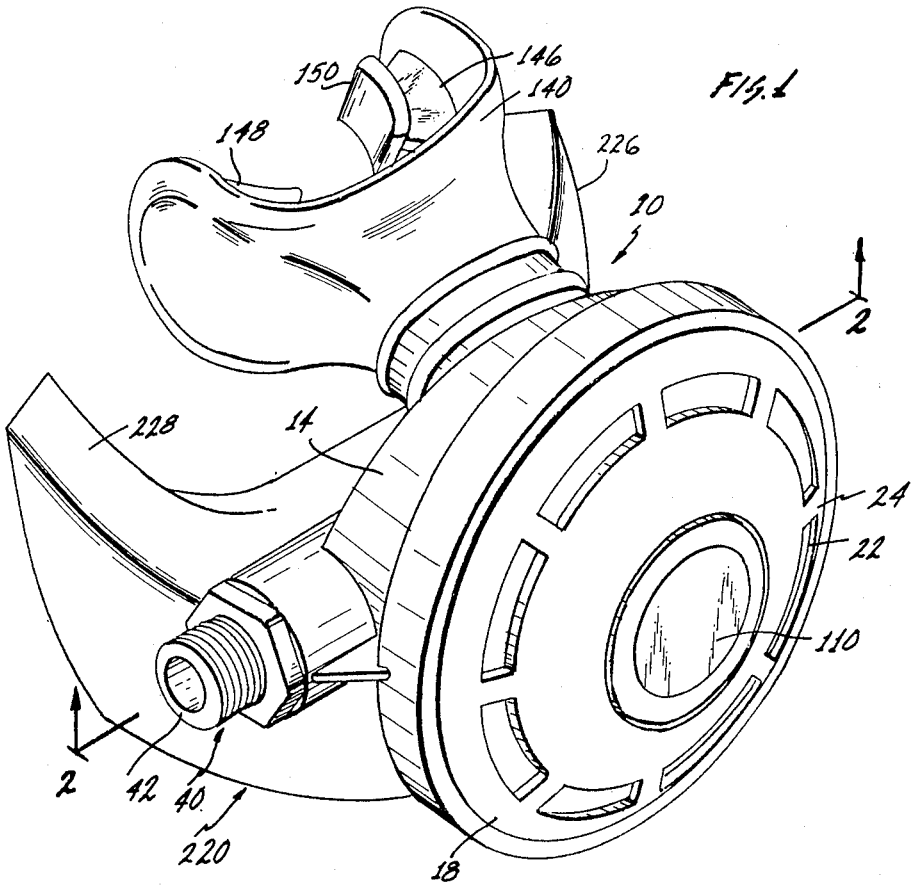
FIG. 1 is a perspective view of the second stage regulator of this invention.
Figure 2:
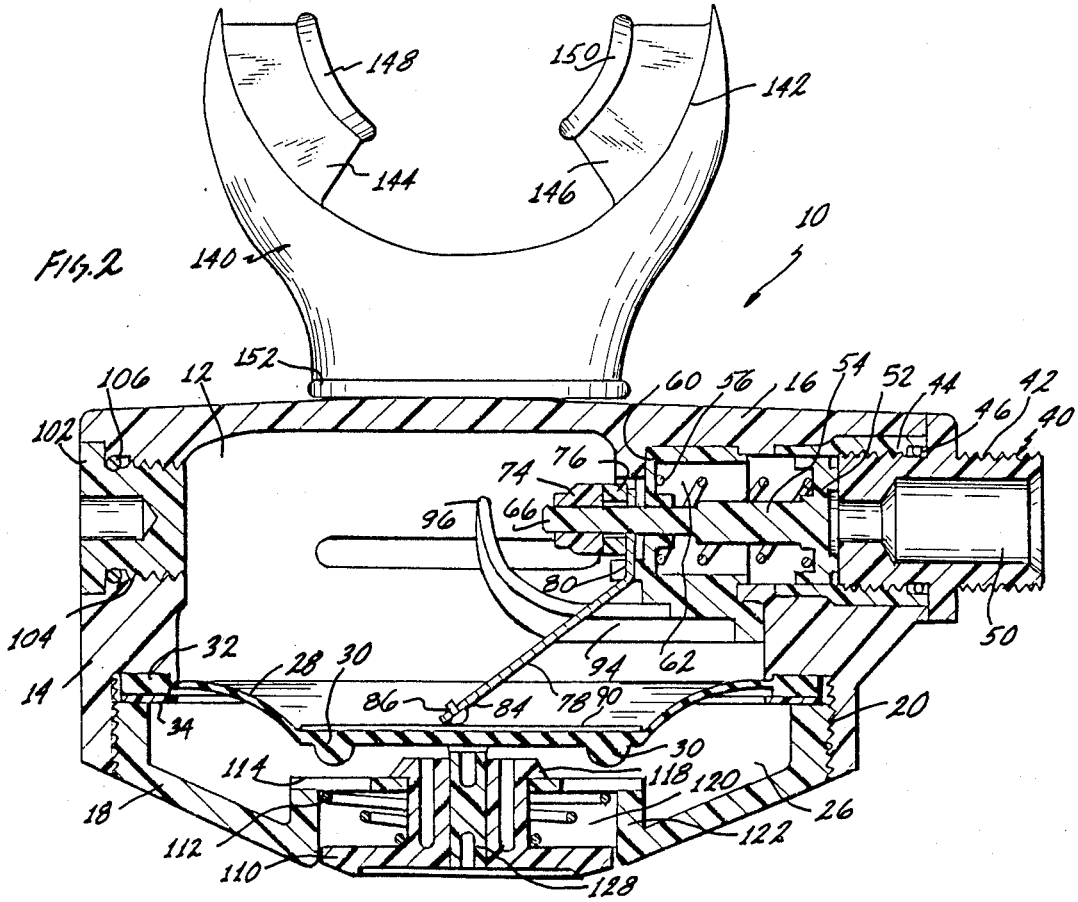
FIG. 2 is a sectional view of the second stage regulator as shown in the direction of lines 2—2 of FIG. 1.

Looking particularly at FIG. 1, it can be seen that a second stage or demand regulator 10 is shown. The demand regulator 10 incorporates a chamber as can be seen in FIG. 2, namely, chamber 12 defined by a circular wall 14 and a relatively flat wall 16. The circular wall defines the chamber in cooperation with a screw type cover 18. The screw type cover engages threads 20 within the circular wall 14.

The cover 18 is vented by means of vents 22 formed between ribs 24 therebetween to allow the flow of ambient pressure into an underlying interfacing space 26. The interfacing space interfaces with a diaphragm 28 that is seated under the threaded cap 18.

The diaphragm 28 can be made of an elastomeric member having protuberances 30 around the surface thereof and an enlarged flange 32. The enlarged flange 32 serves as a seal of the diaphragm 30. In addition thereto, an O ring 34 can be utilized to seal the elastomeric portion of the flange 32 when the cap is turned down within the threads 20. This provides for a tightened seal of the diaphragm 28 against the walls 14 of the regulator.

The regulator incorporates a demand type valve in the form of a tilt valve assembly 40. The tilt valve assembly 40 has a threaded nipple 42 which is seated within an interior sleeve 44 of the tilt valve assembly and within the circular walls 14. In order to seal the nipple 42 an O ring is utilized to seal it into the sleeve 44.

The tilt valve assembly has a passage 50 leading through the nipple that is exposed to a valve seat 52. The valve seat 52 is valved by a valve stem 54.

The valve stem 54 is biased by a spring 56 against the valve set 52. This is accomplished by means of the spring 56 engaging the valve stem 54 and extending it between the walls 60 of a portion of the circular wall 14 which defines a chamber 62 around the spring 56.

The stem terminates outwardly (in chamber 12) with an extension portion 66. The extension portion 66 is surrounded by means of a locking nut 74 or other suitable means in order to hold a bearing surface 76 in the form of a bearing ring. The foregoing bearing ring and locking means 74 and 76 respectively allow for a lever 78 having a valve stem engagement connection 80 to engage the bearing surface 76. At the other end of the lever 78 is a driven operating end 84 having a bearing surface 86 seated within the lever 78. The bearing surface 86 can be in the form of a plastic or other similar button for movement of the lever 78 smoothly in order to engage the diaphragm on a smoothly operating contact basis.

The diaphragm 28 has a metallic disk 90. The metallic disk 90 allows the diaphragm 28 to move inwardly and outwardly and engage the bearing surface 86 so as to move the lever 78. As the diaphragm 28 moves inwardly and outwardly, it causes the lever 78 to move in response thereto respectively to the left and up and to the right and down of the drawing. As the lever moves inwardly, it lifts the valve stem 54 so as to allow the valve stem to expose the valve seat 52 for the passage of gas through the passageway 50.

The chamber 12 then receives the gas as it passes through the surrounding chamber 62 into the chamber 12. The gas is deflected by means of a deflector curved surface. Specifically, a deflector 94 is shown having a curved surface 96 which deflects the gas toward a user's mouthpiece, which shall be described hereinafter.

The foregoing is generally known in the art as a standard second stage regulator or demand regulator 10. However, a somewhat different configuration of purge valve is shown herein from that known in the prior art and oftentimes the deflection is not provided for in the manner of the curved deflector 94 as shown.

A closure of the chamber 12 is formed by means of a plug 102 which is seated by threads 104 into the chamber wall 14 and is sealed therein by means of an O ring 106.

The purge button as previously mentioned allows for a displacement of the lever 78 inwardly or to the left and upwardly so as to cause the flow of gas through the opening 50 by relief of the valve surface 52 for the passage of gas therein. This is accomplished by a button 110 having a spring 112 underlying the button. The spring 112 seats against an inner surface 114 provided by a circumferential ledge and holds the button by means of extensions 118 on the back surface thereof so that it does not move out of a cup or pocket 120 in which it is seated. The pocket 120 of course as can be seen is provided by an interior walled surface 122 which circumscribes the spring 112 and allows the button 110 to pass inwardly and outwardly.

An adjustment screw 128 is shown which can be threaded into and out of the button 110 so as to allow for different height adjustment of the button 110 and spring pressure as it relates to the operation of the purge button. Thus, different degrees of pressure can be exerted by the screw 128 against the diaphragm 28. This is done by the adjustment of the screw 128 as it is threaded inwardly and outwardly of the button 110.

In operation, the button 110 is displaced inwardly against the spring pressure of spring 112 which causes the diaphragm 28 to extend inwardly and concomittantly against the bearing surface 86.

The lever based upon the internal pressure of the button 110 then moves so as to allow for a displacement of the valve stem 54. This displacement of the valve stem 54 then causes a flow of gas through the passage 50 so as to purge water and gas from the chamber 12 outwardly through the exhaust valve as will be described hereinafter.

The chamber 12 as can be seen in FIG. 3 and the external showings have a mouthpiece 140 connected thereto. The mouthpiece 140 comprises a mouthpiece flange 142 with a pair of bits 144 and 146. The bits 144 and 146 have enlargements 148 and 150 in order to allow for a person to bite down and seat one's teeth on the bits 144 and 146 and retain the mouthpiece 140 in a user's mouth. The mouthpiece 140 has a flange 152 and an internal groove which seats over a pair of circular portions 156 and 158 with a groove 160 therebetween. The mouthpiece 144 is elastomeric and when applied thereover seats in the foregoing circular portions 156 an 158 in the groove 160.

The foregoing configuration comprises the outer surfaces of a breathing tube 170 having a passage 172 passing therethrough. The passage 172 passing through the breathing tube 170 delivers a flow of gas as can be seen by the arrows into the chamber 12. This is provided by flow over a surface 176 that can be formed as a portion of an elipse, a circle, or other arcuate surface.

The foregoing surface 176 as previously stated, can be formed as a portion of an elipse, a circle or other arcuate surface. During the experimentation for providing the best mode, it was felt that a segment of an elipse would be preferable. This was based upon the desire to maintain non-turbulent flow conditions.

As an aside, diaphragm second stage regulators generally have a tube of the type 170 having a passage 172 flowing therethrough. This passage, of course, connects the mouthpiece of the regulator, namely, mouthpiece 140 as described hereinbefore. The mouthpiece can be variously configured so that the flanges and connection means as described herein are not necessary if it connects directly to the chamber 12 of the regulator. However, it is felt in this particular instance the aspects of the connecting tube can be substituted for a mouthpiece in direct connection thereto. The one consideration is that an effort to produce laminar flow should be maintained as much as possible from the exit of the mouthpiece into the chamber.

The foregoing can be generally provided by an analysis of the exhalation cycle wherein the exhaust air passes through the tube 170 or mouthpiece directly into the chamber 12. It is in this transition that the flow is received in an analogous manner into an expansion chamber.

The foregoing abrupt transition of the exhaust air changes from laminar flow to turbulent flow when the prior art is utilized. This can be seen in the format generally shown in FIG. 7 wherein arrows 502 are shown flowing into a prior art chamber 504 over a sharpened edge 506. The flow is analogous to the flow through tube 170 or a direct connecting mouthpiece and has been exemplified by tube 170*a* and flow channel 172*a*.

In effect, the differing characteristics of the channel 170*a* from channel 170 resides within the sharpened or direct edge 506. This creates an expansion within chamber 504 so that the flow in some measure ends up in a turbulent condition shown by the turbulence 510 of FIG. 7. It is this particular turbulence that creates the problem.

In effect, the abrupt transition to the expansion chamber creates a situation wherein turbulence is increased. This equates to an increased resistance. The increased resistance adds work to the breathing cycle so that upon exhalation, a breather is confronted with the turbulent configurations insofar as the flow is concerned. If the transition is not as abrupt, it has been found that a laminar flow condition can be enhanced. As the increase in laminar flow takes place, the air resistance becomes less.

In the experimentation, it was found that improved laminar flow could be increased by a smoother surface, such as a simple radius. However, optimization of the laminar flow was found to be developed from a segment of an elipse. The segment of the elipse joining the tube 170 to the chamber 12 was deemed to be quite critical. It is at this point that the non-turbulent condition is enhanced.

It should be understood that various non-turbulent and enhancements of laminar flow can be utilized depending upon the particular chamber 12 and regulator 10. This is due to the fact that flow rates into the chamber 12 are somewhat dependant upon exhaust conditions, back pressures, and other related items. Thus, it is believed that one skilled in the art, once the determination of the requirement for increased laminar flow and less turbulent flow is developed, can evolve the specific configuration for the inlet across surfaces 176.

As can be seen from FIG. 5, surface 176 is formed from a segment of an elipse that has been dotted into configuration in the form of a dotted elipse 520. However, it should be understood that the surface 176 can be formed in any particular manner, so long as it implements the enhanced characteristics of laminar flow. The edge region of the inlet 170 at point 522 or at portion 524 can be derived so as to create any particular configuration so long as there is laminar flow. The elipse 520 as shown is only for purposes of exemplary showing of regulators having the specific configuration of the Applicants' regulator indicated herein. However, it should be borne in mind that curved surfaces providing the laminar flow in the suitable manner as indicated, are the essence of the invention. This can be seen in the arrows indicated as arrows 530 of FIG. 5 flowing in the lines of flow into the chamber wherein substantially laminar flow is maintained as opposed to the turbulent flow seen in FIG. 7. Consequently, it is believed that this invention should be understood to encompass various curved surfaces which effectuate the increased laminar flow from the mouthpiece of a regulator, such as mouthpiece 140 into a chamber of a regulator, such as chamber 12.

The flow of gas through the chamber 12 extends downwardly to an exhaust valve assembly 180. The exhaust valve assembly 180 incorporates a plurality of ribs 182 which are shown in dotted configuration. The plurality of ribs 182 have openings 183 therebetween to allow the exhaust valve to function.

Exhaust valves are known in the prior art which allow for the passage of gas through the openings outwardly through spaces 183 between the ribs 182. The ribs 182 extend radially from a central ring portion in order to receive a mushroom valve formed of an elastomeric circular member 186 that circumscribes the exhaust valve opening and has a stem 188 with a protuberance 190 extending thereinto. The protuberance 190 seats behind a circular ring member 194 on the interior of the ribs 182.

The elastomeric circular member 186 is held in place by elastomerically passing into an opening and being seated against the interior portion of the circle 194 which comprises the center of the ribs 182. Thus, the circular valve member 186 of the mushroom valve is allowed to flap outwardly and inwardly upon respective exhaust and intake of air. It seals in accordance therewith the valve 186 against the surface of the ribs 182 and the surrounding area 202 as can be seen.

As the exhaust emanates from the area adjacent the mushroom valve assembly 180 it encounters a substantial enlargement or protuberance 200. The protuberance 200 can be defined as a conical bump or smooth conical member extending toward the exhaust valve assembly 180. This conical member 200 has an apex which is generally within the center of the conical member 200 and more particularly aligned with the center of the disk 186 that comprises the mushroom flapper valve circular portion.

The regulator 10 has a circular tube or outer walled member 208 which has an outturned flange 210 which receives the assembly referred to as an exhaust tee. In particular, the exhaust tee comprises tee member 220. The exhaust tee member 220 has two outlet ports. The outlet ports are defined within outlet tee portions, legs or conduits, respectively 226 and 228 seen in FIG. 1.

The outlet tee portions 226 and 228 terminate in relatively rectangular end portions.

The foregoing configuration of the exhaust portions 226 and 228 is not a necessary requisite of this invention, so long as exhaust can be delivered outwardly.

The exhaust must pass through an opening of the exhaust tee 220. As the exhaust passes outwardly, the flow of air from the exhaust valve assembly 180 is directed over the protuberance, bulb or conical member 200 so as to expand over and across the surface. This more evenly deflects the air and water from the exhaust tee during the exhalation cycle. This equates to less resistance and thereby less effort upon the part of the diver or user of self contained breathing apparatus.

In addition to the foregoing, the bulbous conical member 200 displaces water volume in the exhaust tee during the non-exhalation period. Thus, when a diver begins to exhale, he does not have to clear as much water out of the tee, which also equates to less effort.

Another feature is that the constant cross section in the direction of the air flow provides for air flow across the exhaust tee protuberance 200 in a more even non-turbulent manner. This means less expansion and compression of the cross sectional flow out of the tee. This also equates to less flow resistance, which is less work upon the part of the diver or user of self contained breathing gas apparatus when exhausting gas.

The exhaust tee 220 incorporates a circular opening 240 as previously stated, which has an interior gripping flange 244 which serves the purpose of seating against the exhaust tube 208. The tight fitting relationship is maintained against the exhaust tube 208 so as to retain the exhaust tee 220 thereon.

The exhaust tee 220 can be of various configurations allowing the flow of exhaust outwardly in any suitable manner. There can be a single exhaust exit substituted for the exhaust exits or a plurality larger than the two. A substantial benefit of this invention is the exhaust tee air dam configuration provided by the protuberance 200 or conical member.

The foregoing disclosure shows a unique improved regulator which enhances operation by the improved laminar flow over the surface 176. This surface, as previously stated, can be of any suitable configuration so long as it increases the laminar flow and decreases the turbulence thereover. It is believed that the method and structure creating laminar flow can also be equated to creating a positive pressure and reduction of backflow and stall at the mouthpiece chamber interfacing area. The result of the configuration is to also limit flow separation until the exhaust is proximate the exhaust valve. It is believed that regardless of the foregoing configuration, this invention should be read broadly as a decreasing of turbulent flow from a mouthpiece exhaust into the breathing box or chamber of a regulator that provides an enhanced regulator which is a substantial contribution over the prior art.

We claim:

1. A second stage breathing gas regulator comprising:

a walled chamber forming a breathing box;

an opening within said walled chamber having a diaphragm implaced therein which is actuatable, depending upon pressures within said chamber and ambient;

valve means for delivering breathing gas into said chamber upon actuation of said diaphragm;

actuation means in operable relationship to said diaphragm for causing said valve means to function upon movement of said diaphragm;

an exhaust valve within said chamber for exhaust of gas from said chamber;

a mouthpiece connected to said chamber by means of an inlet opening from said mouthpiece into said chamber; and wherein, said opening extends into said chamber with a curved surface at the interface with said chamber nearest to said exhaust valve to help maintain laminar flow from said mouthpiece into said chamber toward said exhaust valve.

2. The regulator as claimed in claim 1 wherein:

said curved surface is formed as an arc of a portion of a circle.

3. The regulator as claimed in claim 1 wherein:

said curved surface is formed as an arc of a portion of an elipse.

4. The regulator as claimed in claim 3, further comprising:

an exhaust valve having an elastomeric member formed with a stem; and, an exhaust valve opening having a plurality of ribs extending from the exterior of said exhaust valve opening toward the center and wherein said stem of said elastomeric member is supported within the central region of said radial extension extending from the periphery inwardly.

5. The regulator as claimed in claim 4 further comprising:

a regulator having a mouthpiece connected to said regulator chamber by means of a mouthpiece tube extending from said mouthpiece to said regulator chamber to the point of said curved surface.

6. The regulator as claimed in claim 5 wherein:

said valve for delivering gas into said chamber comprises a tilt valve having a spring biased valve piston which seats against a valve seat, and a lever connecting the diaphragm to said spring biased piston so that as said diaphragm is actuated inwardly to the chamber, it causes said tilt valve connector to move said tilt valve under the spring biased condition thereof.

7. The regulator as claimed in claim 5 further comprising:

a purge button connected to said diaphragm for causing said diaphragm to move into the chamber so that flow can be provided when said purge button is actuated and said lever is moved by said diaphragm to cause flow through said valve.

8. A diaphragm type second stage breathing gas regulator having a mouthpiece, a walled chamber defining a breathing box, an exhaust valve, and a diaphragm for operating an inlet valve thereto wherein the improvement comprises:

a mouthpiece connected to the chamber by means of an opening having a curved surface at the chamber nearest to said exhaust valve to enhance laminar flow in the direction of the exhaust valve.

9. The improved regulator as claimed in claim 8 wherein:

said curved surface is formed with an arc of a circle.

10. The regulator as claimed in claim 8 wherein:

said curved surface is formed with a surface defining an arc from an elipse.

11. The regulator as claimed in claim 10 wherein:

said opening to said mouthpiece is formed within a tube extending from said chamber to said mouthpiece with said mouthpiece at one end and said curved surface at the other end extending into said chamber in a manner to enhance laminar flow and diminish turbulence.

12. The improved regulator as claimed in claim 11 further comprising:

a tilt valve forming said inlet valve means extending into said chamber having a tilt valve lever connected to said valve which causes said piston of said tilt valve to function; and wherein, said lever is in contacting relationship to said diaphragm so that when said diaphragm is flexed into said chamber, it causes said tilt valve lever to move and displace the piston of said tilt valve for introduction of breathing gas into said chamber.

13. The improved regulator as claimed in claim 12 further comprising:

a purge button connected externally to said diaphragm from said chamber in connected relationship to said diaphragm for pushing said diaphragm into said chamber while at the same time causing said lever contacting said diaphragm to move in reponse thereto to cause a flow of gas.

14. The method of providing regulated breathing gas comprising:

providing a chamber;

connecting said chamber to a supply of breathing gas;

introducing said gas into said chamber by means of a valve;

causing said valve to function by moving said valve through the means of a lever;

moving said lever by means of a diaphragm which when moved into said chamber causes said lever to deflect and move said valve;

providing a mouthpiece in connected relationship to said chamber;

flowing exhaust from a breather to said mouthpiece into said chamber over a curved surface to enhance laminar flow as exhaust from said mouthpiece is introduced into said chamber; and, exhausting flow from said mouthpiece through an exhaust valve which is nearer to said curved surface than any other portion of where exhaust is introduced into said chamber.

15. The method as claimed in claim 14 wherein:

said laminar flow is enhanced by flowing said exhaust over a curved surface to maintain the velocity component roughly parallel to the diaphragm at the entrance to said chamber from said mouthpiece.

16. The method as claimed in claim 15 wherein:

said curved surface comprises a portion of an arc of a circle.

17. The method as claimed in claim 15 wherein:

said curved surface comprises a segment of an elipse.

18. The method as claimed in claim 15 further comprising:

providing a contoured segment from said mouthpiece into said chamber to create a positive pressure and limit backflow and stall of the flow into said chamber.

19. The method as claimed in claim 15 further comprising:

exhausting said chamber through an elastomeric exhaust valve.

20. The method as claimed in claim 14 further comprising:

flowing exhaust into said chamber while limiting the separation of said exhaust until proximate said exhaust valve.

* * * * *